US012043952B2

(12) United States Patent
Zhang

(10) Patent No.: US 12,043,952 B2
(45) Date of Patent: Jul. 23, 2024

(54) ELECTRIC STEAM IRON

(71) Applicant: Li Zhang, Shenzhen (CN)

(72) Inventor: Li Zhang, Shenzhen (CN)

( * ) Notice: Subject to any disclaimer, the term of this patent is extended or adjusted under 35 U.S.C. 154(b) by 23 days.

(21) Appl. No.: 18/102,894

(22) Filed: Jan. 30, 2023

(65) Prior Publication Data

US 2024/0175198 A1 May 30, 2024

(30) Foreign Application Priority Data

Nov. 28, 2022 (CN) ..... 202223167658.0

(51) Int. Cl.

| | |
|---|---|
| ***D06F 75/16*** | (2006.01) |
| ***D06F 75/20*** | (2006.01) |
| ***D06F 75/24*** | (2006.01) |
| ***D06F 75/26*** | (2006.01) |

(52) U.S. Cl.

CPC ..... *D06F 75/16* (2013.01); *D06F 75/20* (2013.01); *D06F 75/24* (2013.01); *D06F 75/265* (2013.01)

(58) Field of Classification Search

CPC ..... D06F 75/08–26; D06F 75/265
See application file for complete search history.

(56) References Cited

U.S. PATENT DOCUMENTS

| | | | | |
|---|---|---|---|---|
| 5,279,054 | A * | 1/1994 | Chasen | D06F 75/24 219/254 |
| 6,216,369 | B1 * | 4/2001 | Wolf | D06F 75/20 38/93 |
| 6,226,904 | B1 * | 5/2001 | Brady | D06F 79/00 38/96 |
| 6,250,593 | B1 * | 6/2001 | Palu | D06F 79/02 38/94 |
| 6,953,912 | B2 * | 10/2005 | Alday Lesaga | D06F 75/38 38/77.83 |
| 10,309,053 | B2 * | 6/2019 | Yagi | D06F 75/18 |

FOREIGN PATENT DOCUMENTS

| | | | | |
|---|---|---|---|---|
| CN | 112301712 A * | 2/2021 | | D06F 75/14 |

* cited by examiner

*Primary Examiner* — Ismael Izaguirre
(74) *Attorney, Agent, or Firm* — Jeenam Park

(57) ABSTRACT

The present disclosure provides an electric steam iron, comprising: a housing provided with a water injection unit, the water injection unit being configured to injecting water; a heating unit comprising a heating shell and a heating element, a first chamber and a second chamber being set in the heating shell, the first chamber is configured for receiving water from the water injection unit; the heating shell is in the first chamber and heats the water in the first chamber to generate steam; the second chamber is connected with the first chamber to receive steam in the first chamber; a first lead-out hole is defined in a bottom of the first chamber; a cover is provided to cover a bottom of the heating shell a steam ironing plate, a steam channel is on the steam ironing plate, the steam channel being distributed on the steam ironing plate in a roundabout manner.

7 Claims, 7 Drawing Sheets

ELECTRIC STEAM IRON

RELATED APPLICATIONS

The present application claims the benefit of and priority to Chinese Patent Application No. 202223167658.0 (hereafter referred to as "the CN202223167658.0"), filed on Nov. 28, 2022, in the China National Intellectual Property Administration. The content(s) of the CN202223167658.0 application are fully incorporated herein by reference for all purposes.

TECHNICAL FIELD

The present disclosure relates to the technical field of home appliance, and more particularly, to an electric steam iron.

BACKGROUND

Existing steam iron on the market generally uses steam function, to achieve facial steaming, skin cleaning, ironing, hanging ironing, etc. The existing irons generally use steam equipment to heat water directly by a heating element in the steam equipment.

However, when steam is applied in a steam iron, since the water is heated inside the first chamber to generate steam, and steam is directly released through a plurality of steam outlets on the ironing plate during the iron process, no additional steam drainage is provided. Thus a part of the steam are not utilized, resulting in a waste of electric energy.

SUMMARY OF INVENTION

In order to overcome the shortcomings of the prior art, the purpose of the present application is to provide an electric steam iron, wherein the steam can be exported in a roundabout state in a steam channel after being exported from a second chamber, and the steam is evenly distributed.

The purpose of the present application is implemented using the following technical method:

An electric steam iron, comprising:

a housing, wherein the housing is provided with a water injection unit, and the water injection unit being configured to injecting water;

a heating unit comprising a heating shell and a heating element, a first chamber and a second chamber being set in the heating shell; the first chamber is configured for receiving water from the water injection unit; the heating shell is in the first chamber and heats the water in the first chamber to generate steam; the second chamber is connected with the first chamber to receive steam in the first chamber; a first lead-out hole is set in the bottom of the first chamber;

a steam ironing plate, a cover is provided to cover a bottom of the heating shell, a steam channel is on the steam ironing plate, the steam channel being distributed on the steam ironing plate in a roundabout manner; the steam channel defining an inlet opening and an outlet opening, and the inlet opening, where the the inlet opening is connected with the first lead-out hole; and the outlet opening defines a plurality of second lead-out holes.

Further, a heat-conducting plate is in the housing, a steam concave groove is on the top of the steam ironing plate, and a plurality of guide pieces distributed at intervals are in the steam concave groove, the plurality of guide pieces being configured for separating the steam concave groove, so that the steam channel is in the steam concave groove.

Further, a transverse guide piece and a plurality of longitudinal guide pieces are in the steam concave groove, adjacent two of the plurality of longitudinal guide sheets being at intervals, and one end of the adjacent two of the plurality of longitudinal guide sheets being connected with the transverse guide sheet; a flow channel is defined by the adjacent two of the plurality of longitudinal guide pieces and the transverse guide piece, and the adjacent two of the plurality of flow channels run through and cooperatively form the steam channel; the bottom of the heating shell is provided with a heat-conducting plate, and the heat-conducting plate seals the cover to the top of the steam concave groove; the heat-conducting plate is provided with a conduction hole, one end of the conduction hole is connected with the first lead-out hole, and another end of the conduction hole is connected with the inlet opening.

Further, a bottom wall of the first chamber is provided with a plurality of convex parts; the first chamber is provided with a plurality of baffle plates, and the plurality of baffle plates are distributed circumferentially around a central axis of the first chamber at intervals; water passages are formed at intervals between adjacent two of partition plates; and a plurality of water passages run through each other.

Further, the first chamber is provided with a water injection opening, and an end portion of the first chamber away from the water injection opening is provided with a lead-out port; the lead-out port is in communication with one end of the second chamber; and an end of the second chamber away from the lead-out port is provided with the first lead-out hole.

Further, the second chamber is formed by two flow passages surrounding two sides of the first chamber and the two flow passages communicated with each other; two sides of the end portion of the first chamber away from the water injection opening are provided with the lead-out port.

Further, a control panel is inside the housing; and a temperature detection component is inside the second chamber, wherein the temperature detection component is configured to detect a temperature inside the second chamber and send a temperature signal; to control panel.

Further, the control panel is provided with a heat sink, the heat sink comprises a heat dissipating base and a cooling flow passage, a bottom of the heat dissipating base defines a recess, and a top of the heat dissipating base defines the cooling flow passage; one end of the cooling flow passage is configured as an inlet end, the other end of the cooling flow passage is configured as an outlet end, and the cooling flow passage comprises a plurality of flow segments; the plurality of flow segments are located between an inlet end and an outlet end and penetrate each other; and a bottom end face of the heat dissipating base is connected to the control panel, so that an end face of the recess and the control panel form a heat dissipation space.

Further, a bottom end of the steam ironing plate is provided with a ball switch, and the ball switch is electrically connected to the control panel.

Further, the electric steam iron further comprises a protective sleeve, and the protective sleeve is configured to cover the steam ironing plate in a detachable manner.

Compared with the prior art, the beneficial effects of the present application lie in that the steam ironing plate is provided with indirectly distributed steam, the steam is led out into a steam channel on the steam ironing plate through a first leading-out hole of a second chamber, indirectly led out through a plurality of second leading-out holes, the steam is dispersed and discharged, and the distribution of the steam is uniform.

BRIEF DESCRIPTION OF DRAWINGS

Aspects of the example disclosure are best understood from the following detailed description when read with the accompanying figures. Various features are not drawn to scale. Dimensions of various features may be arbitrarily increased or reduced for clarity of discussion.

DETAILED DESCRIPTION

Figure 1:
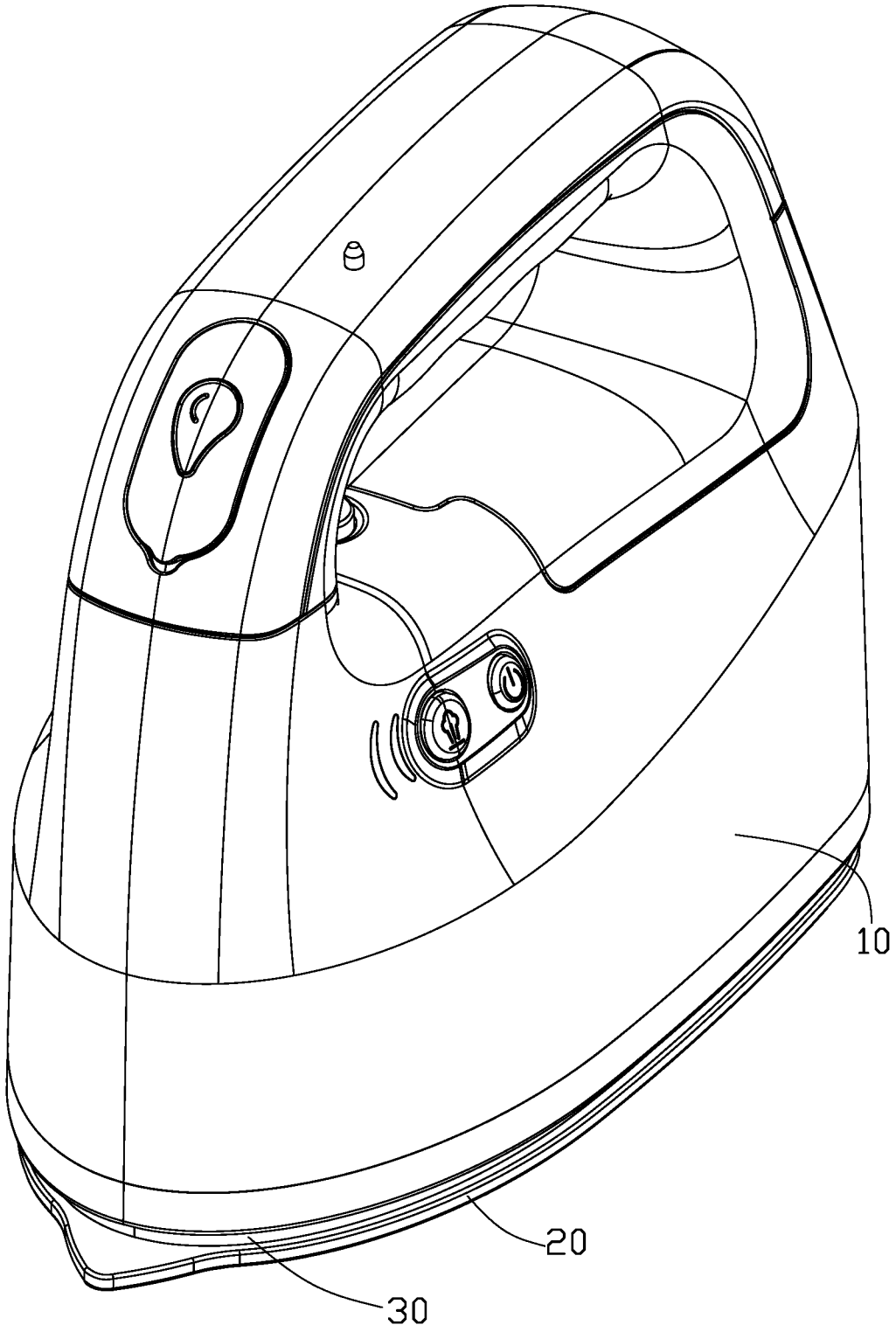
FIG. 1 is a structure diagram of an electric steam iron of the present disclosure.

The following contains specific information related to implementations of the present disclosure. The drawings and their accompanying detailed description are merely directed to implementations. However, the present disclosure is not limited to these implementations:

An electric steam iron as shown in FIGS. 1-7, comprising a housing 10, a heating unit and a steam ironing plate 20, wherein a water injection unit is provided in the housing 10, and the water injection unit can implement a water guiding action.

Specifically, the heating unit comprises a heating shell 40 and a heating element 41. A first chamber 42 and a second chamber 43 are provided in the heating shell 40. The first chamber 42 can receive water introduced by the water injection unit. The heating shell 40 is provided in the first chamber 42 and heats water in the first chamber 42 to generate steam. the second chamber 43 is in communication with the first chamber 42 to receive steam in the first chamber 42; a first lead-out hole 441 is provided at the bottom of the second chamber 43.

In addition, the steam ironing plate 20 covers the bottom end of the shell 10; the steam ironing plate 20 is provided with steam channels, and the steam channels can be distributed on the steam ironing plate 20 in a roundabout manner; The steam channel is provided with an inlet end and an outlet end, the inlet end is in communication with the first lead-out hole 441, and the outlet end is provided with a plurality of second lead-out holes 21.

Based on the above-mentioned structure, when using the electric steam iron of the present disclosure, water can be guided into the first chamber 42 of the heating shell 40 by the water injection unit, The water in the first chamber 42 is heated during the heating process of the heater, and the water in the first chamber 42 may become steam during the heating process, a state in which water and steam coexist is formed in the first chamber, and they enter the second chamber, and a flow passage in the state in which the water and steam coexist is prolonged through the second chamber, facilitating the generation of steam, and preventing water from entering the first lead-out hole before becoming steam, This causes water leakage.

After extending the path through the second chamber, the steam can be exported through the first lead-out hole after vaporization as far as possible, and then introduced through the inlet end of the steam channel.

The steam entering the steam channel may flow to the outlet end of the steam channel along the detour-state steam channel, and during the flow process, the steam is guided out in the detour-state through a plurality of second lead-out holes 21 at the outlet end, so that the steam can be guided out uniformly through the second lead-out holes 21 on the steam ironing plate 20. In addition, the steam can be distributed and exported, which can reduce water leakage caused by condensation caused by steam concentration.

Certainly, a sealing silicone ring may be fitted in a sealing manner around the outer periphery of the first leading-out hole 441 of the second chamber 43. In addition, a silicone ring is added to all the heaters for sealing. The gas enters the first leading-out hole 441 to form a flow channel for pressurization. The steam pressure formed in the sealed environment is greater, which is convenient for the first lead-out hole 441 to be quickly exported.

It should be noted that the water injection unit comprises a water tank 51, a water pump and a water pipe 55. The above-mentioned water pipe 55 may be selected as a hose structure in the prior art, so as to facilitate the running of the water pipe 55 in the housing 10 according to the positions of various components. During water injection, a water pump may be set in the water tank 51. The water pump may guide water in the water tank 51 into the first chamber 42 of the heating shell 40 through the water pipe 55. In addition, the heater may be implemented by using a heating coil structure or a heating wire in the prior art.

In addition, the above-described water pipe can be selected as a hose in the prior art. The hose structure can be bent, extended and sheltered according to the structure inside the housing, and is adapted to a complex structure inside the housing, thereby reducing the blockage of the water passages caused by the pressure from internal parts.

Further, a heat-conducting plate may also be set in the housing 10, a steam concave groove 22 is set at a top end of the steam ironing plate 20, and a plurality of guide pieces distributed at intervals are correspondingly set in the steam concave groove 22. In this way, the plurality of guide pieces may separate the steam concave groove 22, so that the steam channel indirectly distributed is formed in the steam concave groove 22. Based on this structure, after the steam is introduced into the steam concave groove 22 via the inlet end, the steam can flow between the guide pieces distributed at intervals; since a plurality of guide pieces are provided, the formed flow channel detours in the steam concave groove 22; and the steam path is guided by the plurality of guide pieces, and can be guided by the plurality of guide pieces to flow, thereby realizing dispersion and export.

Based on the above structure, the described plurality of second lead-out holes 21 may be distributed between two adjacent guide pieces.

Figure 6:
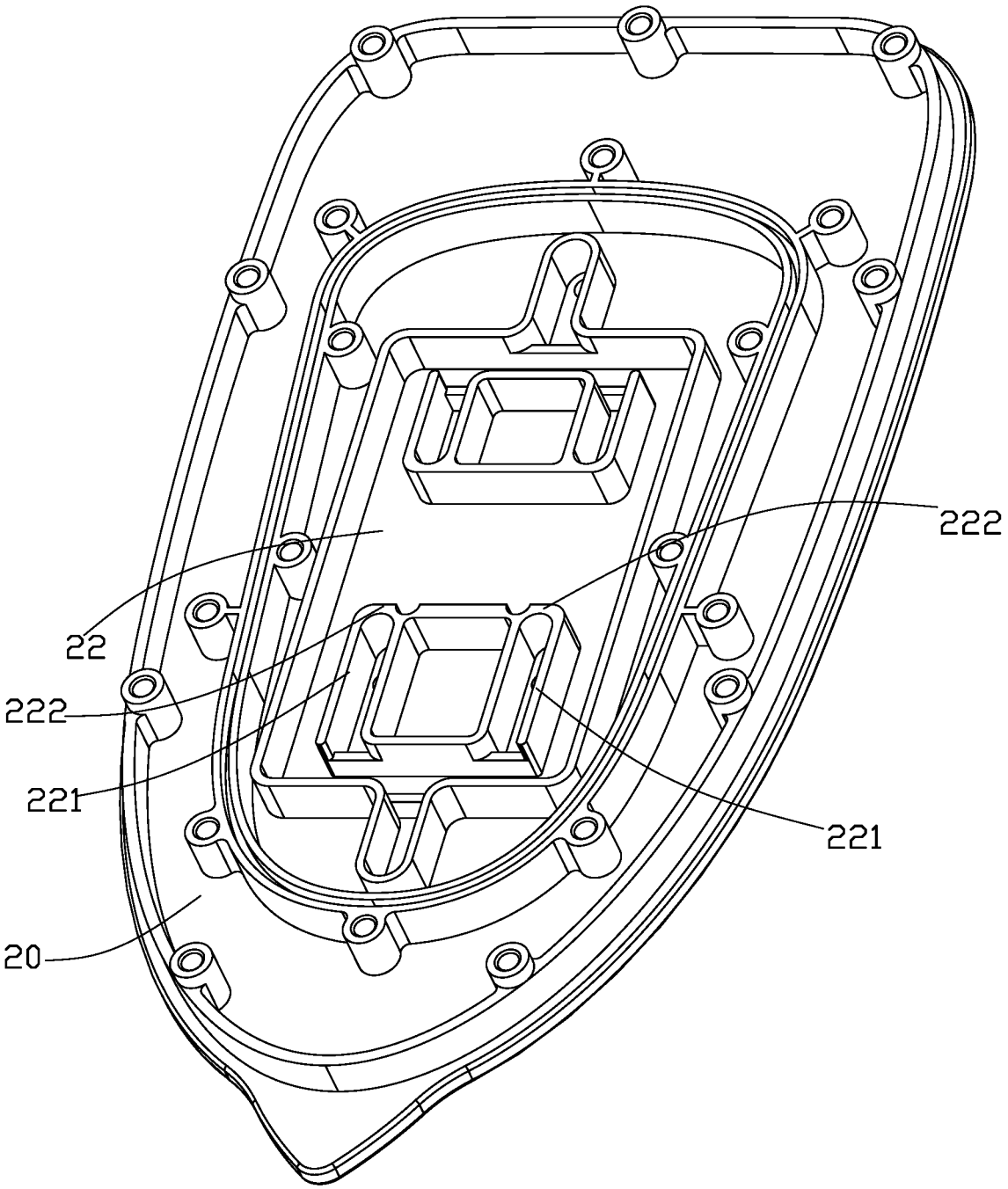
FIG. 6 is a structure diagram of a steam ironing plate of the electric steam of the present disclosure.

Further, referring to FIG. 6, transverse guide pieces 222 and a plurality of longitudinal guide pieces 221 are set in the steam concave groove 22, two adjacent longitudinal guide pieces 221 are provided at intervals, and one end of the two adjacent longitudinal guide pieces 221 is connected via a transverse guide piece 222, Specifically, the two adjacent longitudinal guide pieces 221 and the transverse guide pieces 222 connected between the ends of the two adjacent longitudinal guide pieces 221 jointly form a flow channel, Two adjacent flow passages penetrate through and together form a steam channel.

In addition, a heat-conducting plate is provided at a bottom end of the heating shell 40, and the heat-conducting plate is sealed and covers a top end of the steam concave groove 22; The heat conducting plate is provided with a conducting hole, one end of the conducting hole is in communication with the first leading-out hole 441, and the other end of the conducting hole is in communication with the inlet end.

Specifically, the heat conducting plate may be locked with the heating shell 40 and the steam ironing plate 20 by using a structure such as a screw or a bolt, and between the two structures are sealed by using a sealing silicone ring.

When the steam is guided, the steam enters the steam concave groove 22 through the conducting hole of the heat-conducting plate and is guided through the inlet end of the steam concave groove 22. The steam can flow in the transverse direction and the longitudinal direction through the longitudinal guide piece 221 and the transverse guide piece 222, so that the flow path is circuitous. In the steam concave groove 22 of the same volume, the flow path of the steam is longer, and the dispersion effect of the steam is better. In addition, the heat-conducting plate is in direct contact with the heat-generating shell 40 to implement heat conduction, so that heat generated by the heater can be conducted to the steam ironing plate 20, thereby reducing cooling of the steam ironing plate 20 and causing condensation.

Certainly, it is also possible to provide guide pieces extending spirally in the steam concave groove 22, and guiding the steam to flow in a spiral direction in a roundabout way can also realize the dispersion and export of the steam and extend the flow route of the steam.

Figure 5:
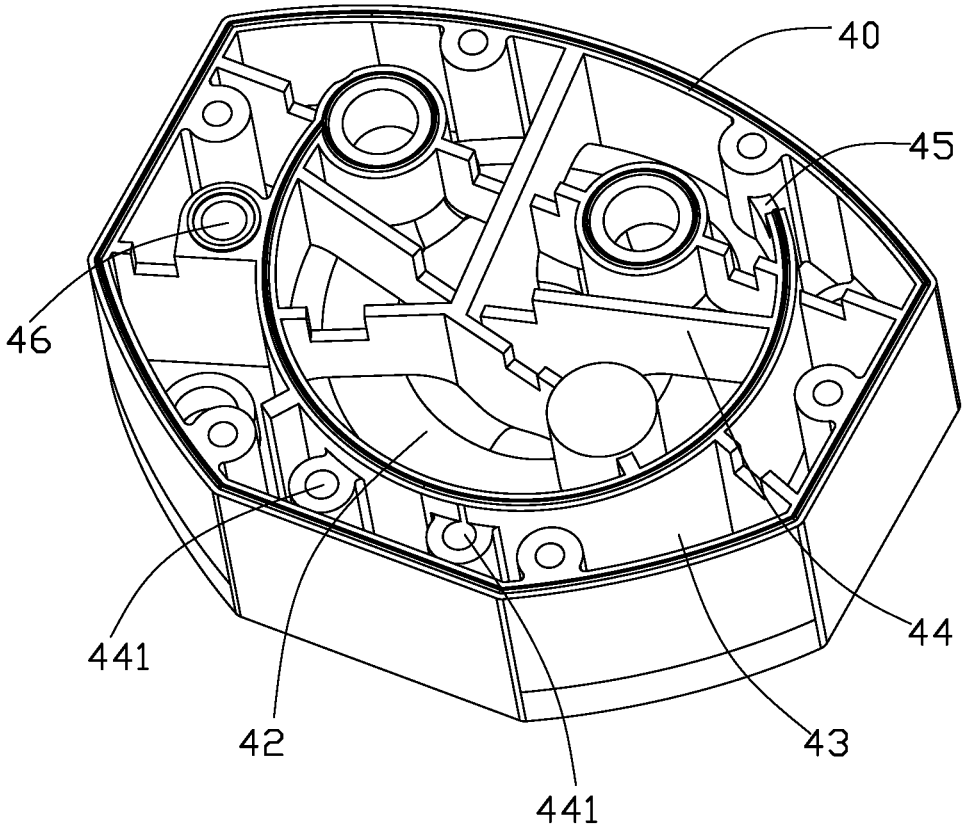
FIG. 5 is a structure diagram of a heating shell of the electric steam of the present disclosure.

Further, referring to FIG. 5, in this embodiment, a plurality of convex portions may be set on the bottom wall of the first chamber, and the plurality of convex portions may be a structure in which a concave-convex shape is formed on the bottom wall of the first chamber. In addition, a plurality of partitions 44 may be further provided in the first chamber 42, and the plurality of partitions 44 are distributed at intervals around a central axis of the first chamber 42; a water passage is formed at intervals between two adjacent partition plates 44; and a plurality of water passages penetrate through each other.

Based on the above-described structure, the first chamber 42 can be heated by a heater, and the first chamber 42 is in a high-temperature state, In this case, water is injected into the first chamber 42, steam is generated instantaneously, and an uneven structure is formed on the bottom wall of the first chamber 42 through a plurality of protruding portions, Compared with a planar structure, the uneven structure can form a contact surface in both the circumferential direction of the convex structure and the top surface due to the arrangement of the convex structure, Accordingly, by means of the uneven structure, a larger contact surface may be formed on the bottom wall of the first chamber, and after the water flows into the first chamber, a higher degree of heat absorption in contact with the first chamber in a high-temperature state, thereby increasing vaporization efficiency.

In addition, the plurality of water passages in the first chamber 42 can reduce the water flow, and also can increase the contact area between the water flow and the first chamber through a plurality of partitions, By means of the arrangement of the described protrusion structure, water can be in more uniform contact with a heater, thereby generating a larger amount of steam, The steam may be guided out from the plurality of steam outlets on the steam ironing plate 20 for steam ironing, and may be continuously generated due to the steam in the first chamber 42, Thus, continuous steam ironing can be implemented.

In addition, the second chamber 43 is separated from the first chamber 42, and the water in the first chamber 42 enters the second chamber 43 only at a height higher than that of the steam pipe, so that the water is not easy to leak; furthermore, when steam ironing is not required, no water can be added in the first chamber 42, the heater directly generates a high temperature, and the steam ironing plate 20 can directly iron at a high temperature.

Further, the first chamber 42 is provided with a water injection opening, and an end portion of the first chamber 42 away from the water injection opening is provided with a lead-out opening 45; The lead-out opening 45 is in communication with one end of the second chamber 43; the end of the second chamber 43 away from the lead-out opening 45 is provided with a first lead-out hole 441, The water injection opening and the first lead-out hole 441 are located at two ends of the heating shell 40, and thus, the water is exported from the first chamber 42 through the end-portion export opening 45 far away from the water injection opening, to the second chamber 43, the steam flows in a roundabout way in the first chamber 42, and the steam introduced into the second chamber 43 flows in a roundabout way to the first lead-out holes 441 to be lead-out, The water leakage prevention effect is better.

More specifically, the second chamber 43 is formed by two flow passages surrounding both sides of the first chamber 42 and communicated with each other; The two sides of the end portion of the first chamber 42 away from the water injection opening are both provided with a lead-out opening 45, and the lead-out openings 45 on the two sides can respectively pour the steam in the first chamber 42 into the second chamber 43 from the two sides. The steam lead-out efficiency is higher.

Figure 4:
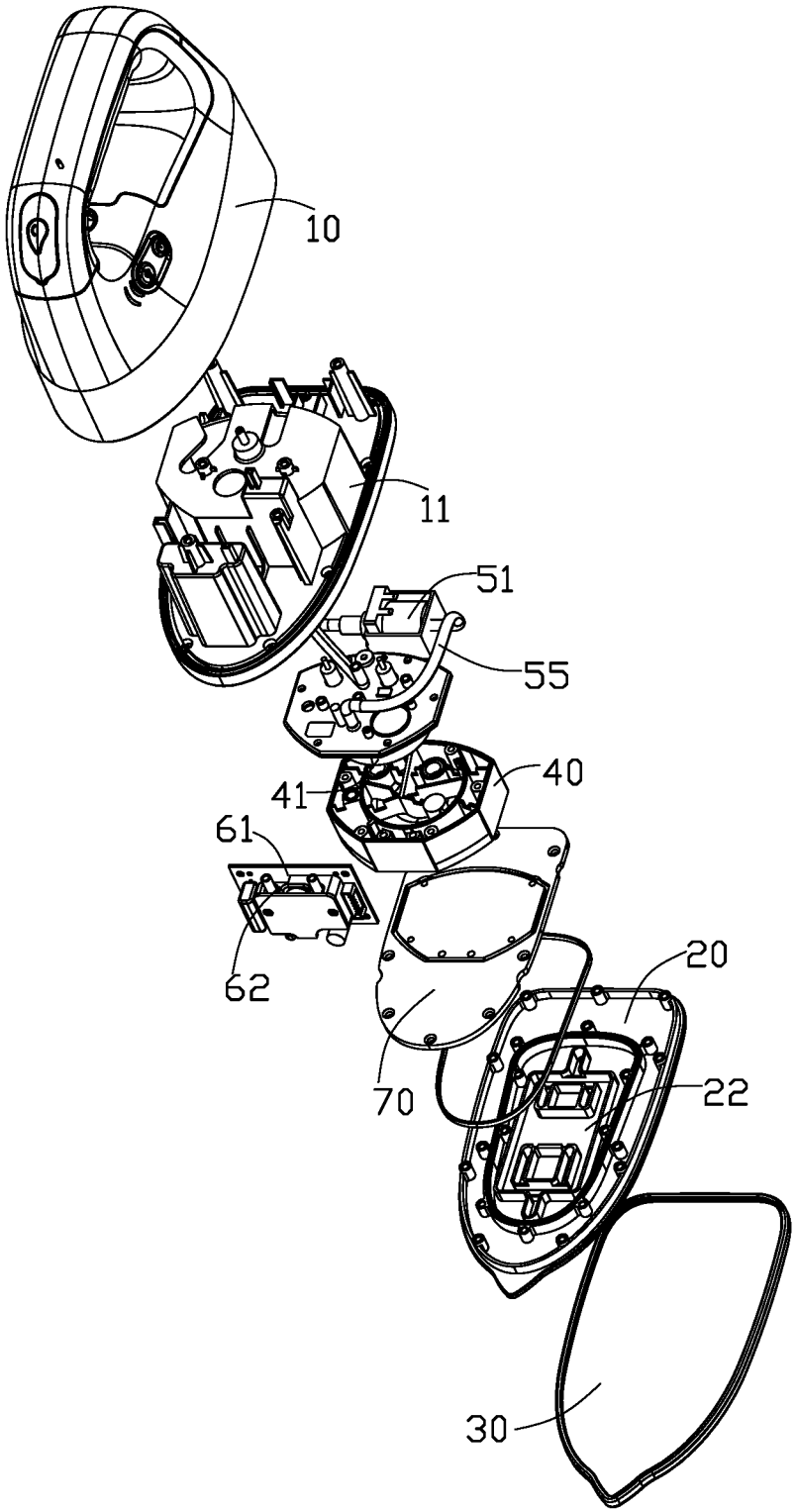
FIG. 4 is a breakdown structure diagram of the electric steam iron of the present disclosure.
Figure 7:
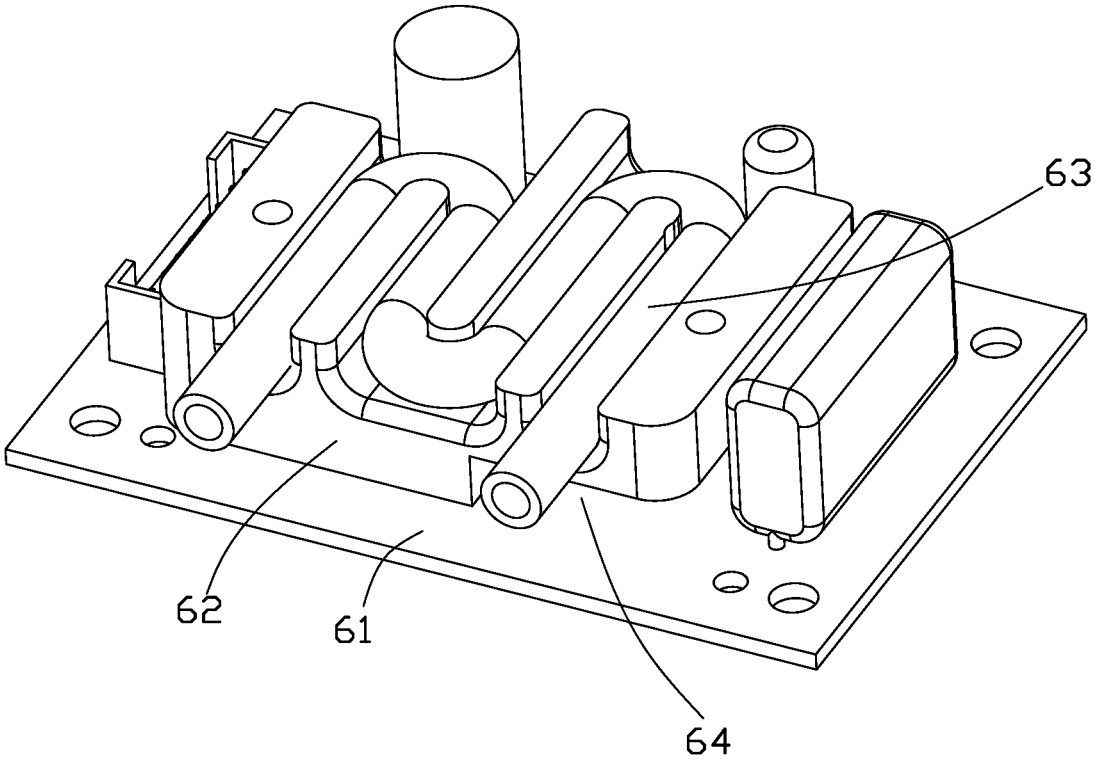
FIG. 7 is a structure diagram of an assembled structure of a control panel and a heat sink of the electric steam of the present disclosure.

Further, referring to FIGS. 4 and 7, a control panel 61 is disposed inside the housing 10, and the control panel 61 is configured to control start and stop of the heating element 41 and the water injection unit; Control panel 61 is provided with a heat sink.

Specifically, a temperature detection component may be disposed on the heating body or the heating shell 40, and the temperature detection component may be selected as a temperature sensor in the prior art. During the assembly, the temperature sensor can detect the heating temperature of the heater or the heating shell 40. The specific temperature sensor can be arranged in the second chamber. The temperature sensor can directly detect the temperature in the second chamber, i. e., detect the temperature of the water-steam coexisting state in the second chamber, and then the temperature signal can be transmitted to the control panel 61. The control panel 61 controls the start and stop of the heating element 41 to prevent burning due to overheating.

However, based on the structure of the water injection unit comprising a water pump, the control panel 61 can control the start and stop of the water pump so as to control the steam volume of steam.

Certainly, a display screen structure may also be disposed on the housing, the display screen structure may display a temperature value detected by the temperature sensor, and then a hand may manually control the working state of the heating element or the water pump according to the temperature displayed on the display screen.

Since electrical components such as the heating element 41 and the control panel 61 are all provided with an electric wire structure, in order to facilitate the installation of the control panel 61 and the heater, a protective bracket 11 may be provided inside the housing 10, the protective bracket 11 is sleeved outside the heater and the control panel 61 to protect the internal electrical components, and the protective bracket 11 and the housing 10 are assembled by using a structure such as a screw or a bolt.

Further, referring to FIG. 7, the heat sink in this embodiment includes a heat dissipating base 62 and a cooling flow passage 63, where a recess is provided at a bottom end of the heat dissipating base 62, and a cooling flow passage 63 is provided at a top end of the heat dissipating base 62. one end of the cooling flow passage 63 is formed as an inlet end, and the other end of the cooling flow passage 63 is formed as an outlet end, the cooling flow passage 63 having a plurality of flow segments; the plurality of flow segments are located between the inlet end and the outlet end and penetrate each other; and the bottom end face of the heat dissipation base 62 is connected to the control panel 61, so that the recess forms a heat dissipation space 64 with the end face of the control panel 61.

In the specific assembly, the heat dissipating base 62 may be assembled with the control panel 61. After the assembly, the recess of the heat dissipating base 62 and the end face of the control panel 61 may form a certain heat dissipating space 64. After the control panel 61 of the circuit board may form a heat dissipating space 64 with the end face of the control panel 61. The heat dissipating space 64 may be thermally conducted when the heat dissipating base 62 contacts an electronic element, thereby implementing large-area air heat dissipation. In addition, a cooling medium can be introduced into the cooling flow passage 63 at the top end of the heat dissipating base 62, and the heat guided by the heat dissipating base 62 can be quickly taken away by the cooling medium, so that double heat dissipation can be implemented, and the heat dissipation effect is better; therefore, the service life of the control panel 61 is longer.

It should be noted that, because the cooling flow passage 63 has a plurality of flow segments, a cooling medium may be introduced into an inlet end of the cooling flow passage 63, the cooling medium flows in a plurality of flow segments in a roundabout way, and then is led out through an outlet end of the cooling flow passage 63, so that a larger cooling area is formed and a better cooling radiating effect is implemented; In addition, the cooling medium flows in and out one by one to realize a unidirectional flow of the cooling medium, thereby preventing the heat carried away by the cooling medium from flowing back again, so that more heat can be carried away.

Further, a ball switch is provided at a bottom end of the steam ironing plate 20, and the ball switch is electrically connected to the control panel 61.

Specifically, the ball switch may be selected as a ball-type induction switch in the prior art. Whether the clothes are scalded is sensed through the balls, to automatically start the ball switch. The ball switch is automatically closed without scalding the clothes, to improve the safety feeling and convenience feeling of using a hanging scalding machine.

Certainly, a handle structure may also be disposed on the housing 10. A human body inductor is installed at a position of the handle structure. The human body inductor senses whether a person holding the handle exists on the handle. When a person holding the handle exists on the handle, the human body inductor may transfer a start signal to the control panel 61, thereby implementing automatic start of the steamer. When a person leaves the handle, the human body sensor senses that a hand leaves, and then the power supply can be automatically turned off, thereby preventing the occurrence of an accident, such as a case where a person leaves a forgetting to turn it off or performs a misoperation, due to a fact, and increasing safety performance.

Figure 2:
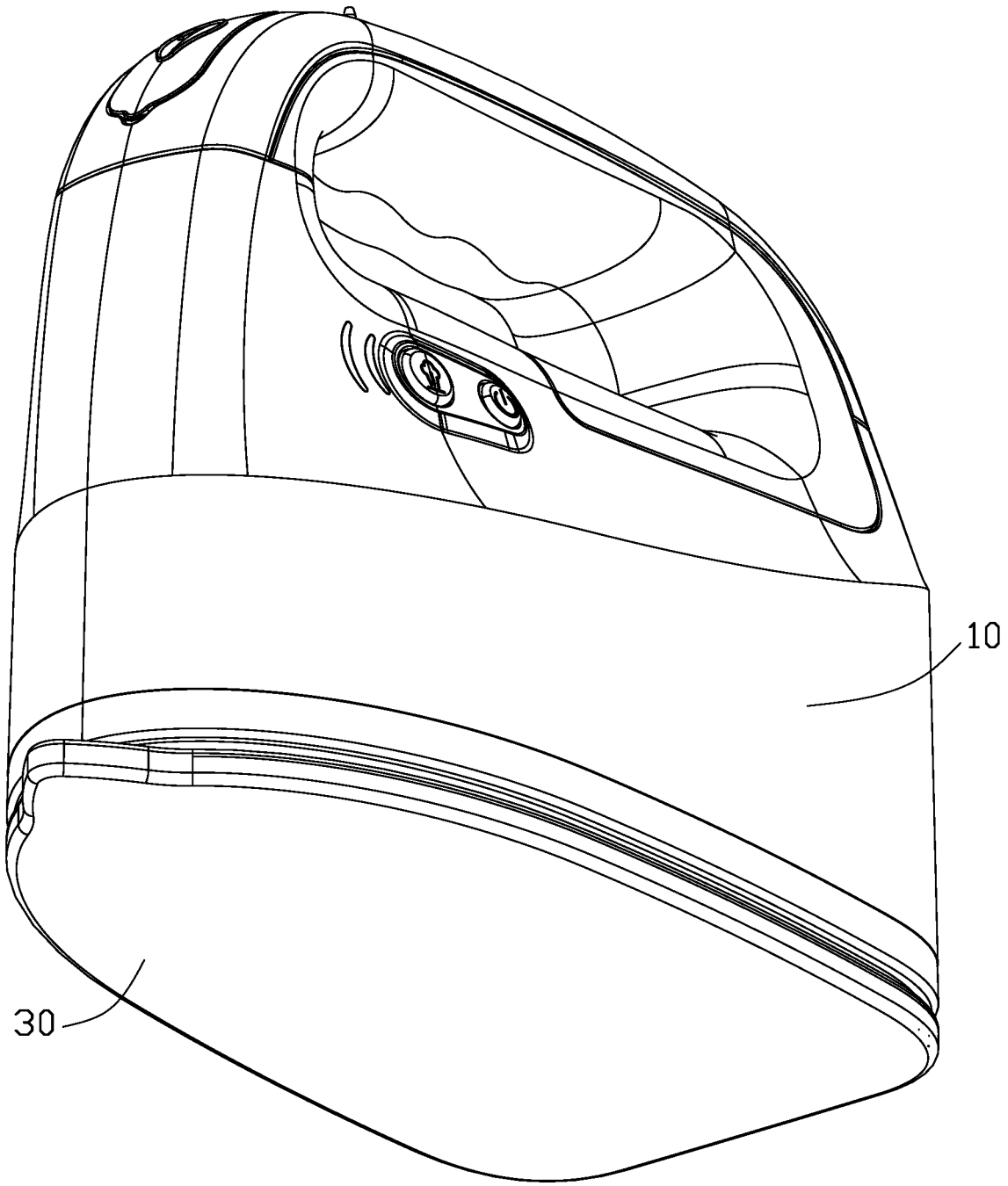
FIG. 2 is a structure diagram that an electric steam iron is provided with a protective sleeve of the present disclosure.
Figure 3:
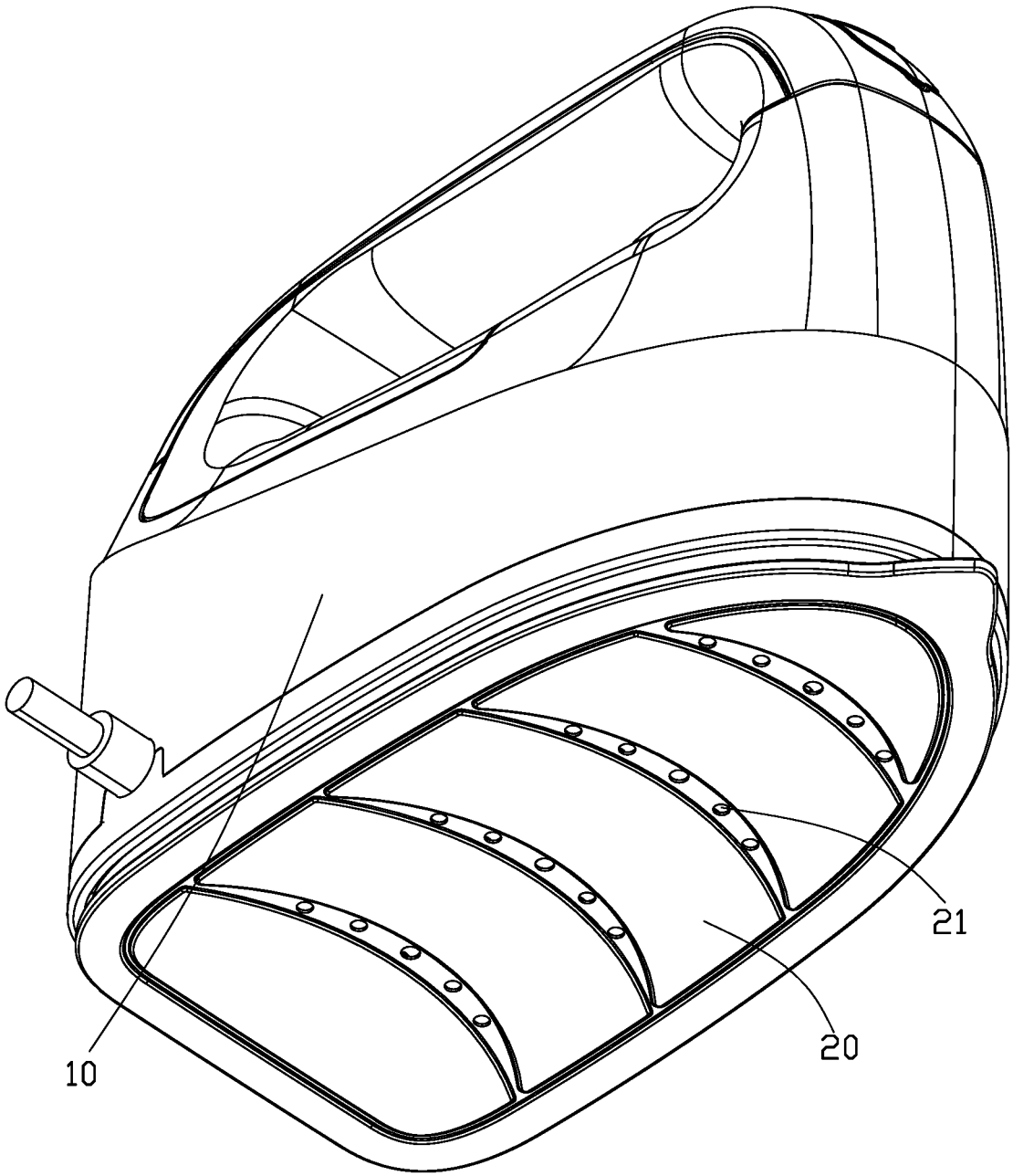
FIG. 3 is a structure diagram that the protective sleeve is removed from the electric steam iron according to the present disclosure.

Further, with reference to FIGS. 1 and 2, the electric steam iron further comprises a protective sleeve 30, and the protective sleeve 30 is detachably wrapped outside the steam ironing plate 20. In practical use, since the temperature of the heater is very high after the clothing is scalded, the residual temperature on the steam ironing plate 20 is also high, and thus the protection sleeve 30 can be sleeved, to protect the heating body from being damaged due to a mistake or being touched by children in an unknown situation, and thus the heating body will not be scalded.

For those skilled in the art, various other modifications and variations can be made according to the above-described technical solutions and ideas, and all these modifications and variations should belong to the scope of protection of the claims of the present disclosure.

What is claimed is:

1. An electric steam iron, comprising:

a housing provided with a water injection unit, the water injection unit being configured to inject water;

a heating unit comprising a heating shell and a heating element, a first chamber and a second chamber being set in the heating shell, wherein the first chamber is configured for receiving water from the water injection unit; the heating shell is in the first chamber and heats the water in the first chamber to generate steam; the second chamber is connected with the first chamber to receive steam in the first chamber; a first lead-out hole is defined in a bottom of the first chamber; and a cover is provided to cover a bottom of the heating shell;

a steam ironing plate, and a steam channel on the steam ironing plate, the steam channel being distributed on the steam ironing plate in a roundabout manner; the steam channel defining an inlet opening and an outlet opening, where the inlet opening is connected with the first lead-out hole; and the outlet opening defines a plurality of second lead-out holes;

wherein the electric steam iron further comprises:

a heat-conducting plate in the housing;

a steam concave groove on a top of the steam ironing plate;

a plurality of guide pieces distributed at intervals in the steam concave groove, the plurality of guide pieces being configured for separating the steam concave groove, so that the steam channel is in the steam concave groove;

a transverse guide piece and a plurality of longitudinal guide pieces in the steam concave groove, adjacent two of the plurality of longitudinal guide pieces being at intervals, and one end of the adjacent two of the plurality of longitudinal guide pieces being connected with the transverse guide sheet, wherein a flow channel is defined by the adjacent two of the plurality of longitudinal guide pieces and the transverse guide piece, and the adjacent two of the plurality of flow channels run through and cooperatively form the steam channel, wherein the bottom of the heating shell is provided with the heat-conducting plate, and the heat-conducting plate seals the cover to a top of the steam concave groove; the heat-conducting plate is provided with a conduction hole, one end of the conduction hole is connected with the first lead-out hole, and the other end of the conduction hole is connected with the inlet opening.

2. The electric steam iron according to claim 1, wherein a bottom wall of the first chamber is provided with a plurality of convex parts; the first chamber is provided with a plurality of baffle plates, and the plurality of baffle plates are distributed circumferentially around a central axis of the first chamber at intervals; water passages are formed at intervals between adjacent two of partition plates; and a plurality of the water passages are interconnected.

3. The electric steam iron according to claim 2, wherein the first chamber is provided with a water injection opening, and an end portion of the first chamber away from the water injection opening is provided with a lead-out port; the lead-out port is in communication with one end of the second chamber; and an end of the second chamber away from the lead-out port is provided with the first lead-out hole.

4. The electric steam iron according to claim 3, wherein the second chamber is formed by two flow passages surrounding two sides of the first chamber and the two flow passages communicated with each other, two sides of the end portion of the first chamber away from the water injection opening are provided with the lead-out port.

5. The electric steam iron according to claim 1, further comprising:

a control panel inside the housing; and a temperature detection component inside the second chamber, wherein the temperature detection component is configured to detect a temperature inside the second chamber and send a temperature signal to the control panel.

6. The electric steam iron according to claim 5, wherein the control panel is provided with a heat sink, the heat sink comprises a heat dissipating base and a cooling flow passage, a bottom of the heat dissipating base defines a recess, and a top of the heat dissipating base defines the cooling flow passage; one end of the cooling flow passage is configured as an inlet end, the other end of the cooling flow passage is configured as an outlet end, and the cooling flow passage comprises a plurality of flow segments; the plurality of flow segments are located between an inlet end and an outlet end and penetrate each other; and a bottom end face of the heat dissipating base is connected to the control panel, so that an end face of the recess and the control panel form a heat dissipation space.

7. The electric steam iron according to claim 1, further comprising:

a protective sleeve, and the protective sleeve is configured to cover the steam ironing plate in a detachable manner.

* * * * *